US006134291A

United States Patent [19]

Roy et al.

[11] Patent Number: 6,134,291

[45] Date of Patent: Oct. 17, 2000

[54] ACOUSTIC INK JET PRINTHEAD DESIGN AND METHOD OF OPERATION UTILIZING FLOWING COOLANT AND AN EMISSION FLUID

[75] Inventors: Joy Roy, San Jose; Babur B. Hadimioglu, Mountain View, both of Calif.

[73] Assignee: Xerox Corporation, Stamford, Conn.

[21] Appl. No.: 09/361,038

[22] Filed: Jul. 23, 1999

[51] Int. Cl.[7] ..... B41J 2/135

[52] U.S. Cl. ..... 377/46

[58] Field of Search ..... 347/46, 85, 89

[56] References Cited

U.S. PATENT DOCUMENTS

| | | | |
|---|---|---|---|
| 4,611,219 | 9/1986 | Sugitani et al. | 347/85 |
| 5,087,931 | 2/1992 | Rawson | 347/89 |
| 5,113,205 | 5/1992 | Sato et al. | 347/85 |
| 5,591,490 | 1/1997 | Quate | 347/46 |
| 5,686,945 | 11/1997 | Quate et al. | 347/46 |

FOREIGN PATENT DOCUMENTS

| | | | |
|---|---|---|---|
| 3438033 | 4/1986 | Germany | 347/71 |

*Primary Examiner*—John Barlow
*Assistant Examiner*—Juanita Stephen
*Attorney, Agent, or Firm*—Nola Mae McBain

[57] ABSTRACT

A droplet emitter with an array of droplet emitting devices constructed such that one flowing liquid is used to create the droplets while a second low acoustic impedance liquid can be used to both make the transfer of acoustic energy to the first liquid more efficient and help maintain a uniform temperature of the droplet emitter array. Both the emission fluid and the low acoustic impedance fluid can be circulated through the droplet emitter to allow for excess heat generated by control electronics to be transferred to the flowing. This prevents for instance excess heat build up within the droplet emitter and allows for higher more accurate droplet emission.

22 Claims, 10 Drawing Sheets

ACOUSTIC INK JET PRINTHEAD DESIGN AND METHOD OF OPERATION UTILIZING FLOWING COOLANT AND AN EMISSION FLUID

INCORPORATION BY REFERENCE

The following U.S. Patents are fully incorporated by reference:

U.S. Pat. No. 5,786,722 by Buhler et al. titled "Integrated RF Switching Cell Built In CMOS Technology And Utilizing A High Voltage Integrated Circuit Diode With A Charge Injecting Node" issued Jul. 28, 1996.

U.S. Pat. No. 5,565,113 by Hadimioglu et al. titled "Lithographically Defined Ejection Units" issued Oct. 15, 1996.

U.S. Pat. No. 5,389,956 by Hadimioglu et al. titled "Techniques For Improving Droplet Uniformity In Acoustic Ink Printing" issued Feb. 14, 1995.

BACKGROUND

This invention relates generally to droplet emitters and more particularly concerns an acoustically actuated droplet emitter which is provided with a continuous, high velocity, laminar flow of cooling liquid in addition to a continuous flow of liquid to be emitted as droplets.

Acoustic droplet emitters are known in the art and use focussed acoustic energy to emit droplets of fluid. Acoustic droplet emitters are useful in a variety of applications due to the wide range of fluids that can be emitted as droplets. For instance, if marking fluids are used the acoustic droplet emitter can be employed as a printhead in a printer. Acoustic droplet emitters do not use nozzles, which are prone to clogging, to control droplet size and volume, and many other fluids may also be used in an acoustic droplet emitter making it useful for a variety of applications. For instance, it is stated in U.S. Pat. No. 5,565,113 issued Oct. 15, 1996 by Hadimioglu et al. titled "Lithographically Defined Ejection Units" and incorporated by reference hereinabove, that mylar catalysts, molten solder, hot melt waxes, color filter materials, resists and chemical and biological compounds are all feasible materials to be used in an acoustic droplet emitter.

One issue when using high-viscosity fluids in an acoustic droplet emitter is the high attenuation of acoustic energy in high-viscosity fluids. High attenuation rates may therefore require larger amounts of acoustic power to achieve droplet emission from high-viscosity fluids. One solution to this problem has been shown in U.S. Pat. No. 5,565,113 issued Oct. 15, 1996 by Hadimioglu et al. titled "Lithographically Defined Ejection Units" and incorporated by reference hereinabove and is shown in FIG. 1.

FIG. 1 shows a cross-sectional view of a droplet emitter 10 for an acoustically actuated printer such as is shown in. U.S. Pat. No. 5,565,113 by Hadimioglu et al. titled "Lithographically Defined Ejection Units" and incorporated by reference hereinabove. The droplet emitter 10 has a base substrate 12 with a transducer, 16 interposed between two electrodes 17 on one surface and an acoustic lens 14 on an opposite surface. Attached to the same side of the base substrate 12 as, the acoustic lens is a top support 18 with a liquid cell 22, defined by sidewalls 20, which holds a low attenuation liquid 23. Supported by the top support 18 is an acoustically thin capping structure 26 which forms the top surface of the liquid cell 22 and seals in the low attenuation liquid 23.

The droplet emitter 10 further includes a reservoir 24, located over the acoustically thin capping structure 26, which holds emission fluid 32. As shown in FIG. 1, the reservoir 24 includes an aperture 30 defined by sidewalls 34. The sidewalls 34 include a plurality of portholes 36 through which the emission fluid 32 passes. A pressure means forces the emission fluid 32 through the portholes 36 so as to create a pool of emission fluid 32 having a free surface 28 over the acoustically thin capping structure 26.

The transducer 16, acoustic lens 14, and aperture 30 are all axially aligned such that an acoustic wave produced by the transducer 16 will be focussed by its aligned acoustic lens 14 at approximately the free surface 28 of the emission fluid 32 in its aligned aperture 30. When sufficient power is obtained, a mound 38 is formed and a droplet 39 is emitted from the mound 38. The acoustic energy readily passes through the acoustically thin capping structure 26 and the low attenuation liquid 23. By maintaining only a very thin pool of emission fluid 32 acoustic energy loss due to the high attenuation rate of the emission fluid 32 is minimized.

FIG. 2 shows a perspective view of two arrays of the droplet emitter 10 shown in FIG. 1. The arrays 31 of apertures 30 can be clearly above the two reservoirs 24. Each array 31 has a width W and a length L where the length L of the array 24 is the larger of the two dimensions. Having arrays of droplet emitters 10 is useful, for instance, to enable a color printing application where each array might be associated with a different colored ink. This configuration of the arrays allows for accurate location of each individual droplet emitter 10 and precise alignment of the arrays 31 relative to each other which increases, among other things droplet placement accuracy.

However, the low attenuation liquid 23, the emission fluid 32, and the substrate 12 will heat up from the portion of the acoustic energy that is absorbed in the low attenuation liquid 23, the emission fluid 32, and the substrate 12 which is not transferred to the kinetic and surface energy of the emitted drops 39. This will in turn cause excess heating of the emission fluid 32. The emission fluid 32 can sustain temperature increases by only a few degrees centigrade before emitted droplets show drop misplacement on the receiving media. In a worst case scenario, the low attenuation liquid 23 can absorb enough energy to cause it to boil and to destroy the droplet emitter 10. The practical consequences of this are that the emission speed must be kept very slow to prevent the low attenuation liquid 23 from absorbing too much excess energy in a short time period and heating up to unacceptable levels.

Therefore, it would be highly desirable if a droplet emitter 10 could be designed to operate while maintaining a uniform thermal operating temperature at high emission speeds.

Further advantages of the invention will become apparent as the following description proceeds.

SUMMARY OF THE INVENTION

Briefly stated and in accordance with the present invention, there is provided a droplet emitter which has a first substrate which has been constructed to provide an array of focussed acoustic waves. The array of focussed acoustic waves has a length and a width wherein the length is greater than the width. The droplet emitter also has a second substrate which is spaced from the first substrate. The second substrate has an acoustically thin portion and an array of apertures which are so arranged such that each aperture may pass substantially unimpeded focussed acoustic waves. The droplet emitter also has a third substrate which is spaced from the second substrate. The third substrate has an array of apertures which are so arranged such that each aperture may receive focussed acoustic waves after they have passed through the array of apertures in the second substrate. Further, there are two liquid chambers, the first at least partially interposed between the first and second substrates and the second at least partially interposed between the second and third substrates. The second liquid flow chamber has an inlet and an outlet and is constructed and arranged to receive a laminar flow of a liquid where a free surface of the liquid is formed by each of the apertures in the third substrate. The focussed acoustic waves received by each aperture aria focussed substantially at the free surface of the liquid formed in the aperture. The laminar flow of liquid flows in through the inlet, out through the outlet and at least a portion of the laminar flow of liquid flows in substantially in the same direction as the length of the array of focussed acoustic waves.

Figure 1:
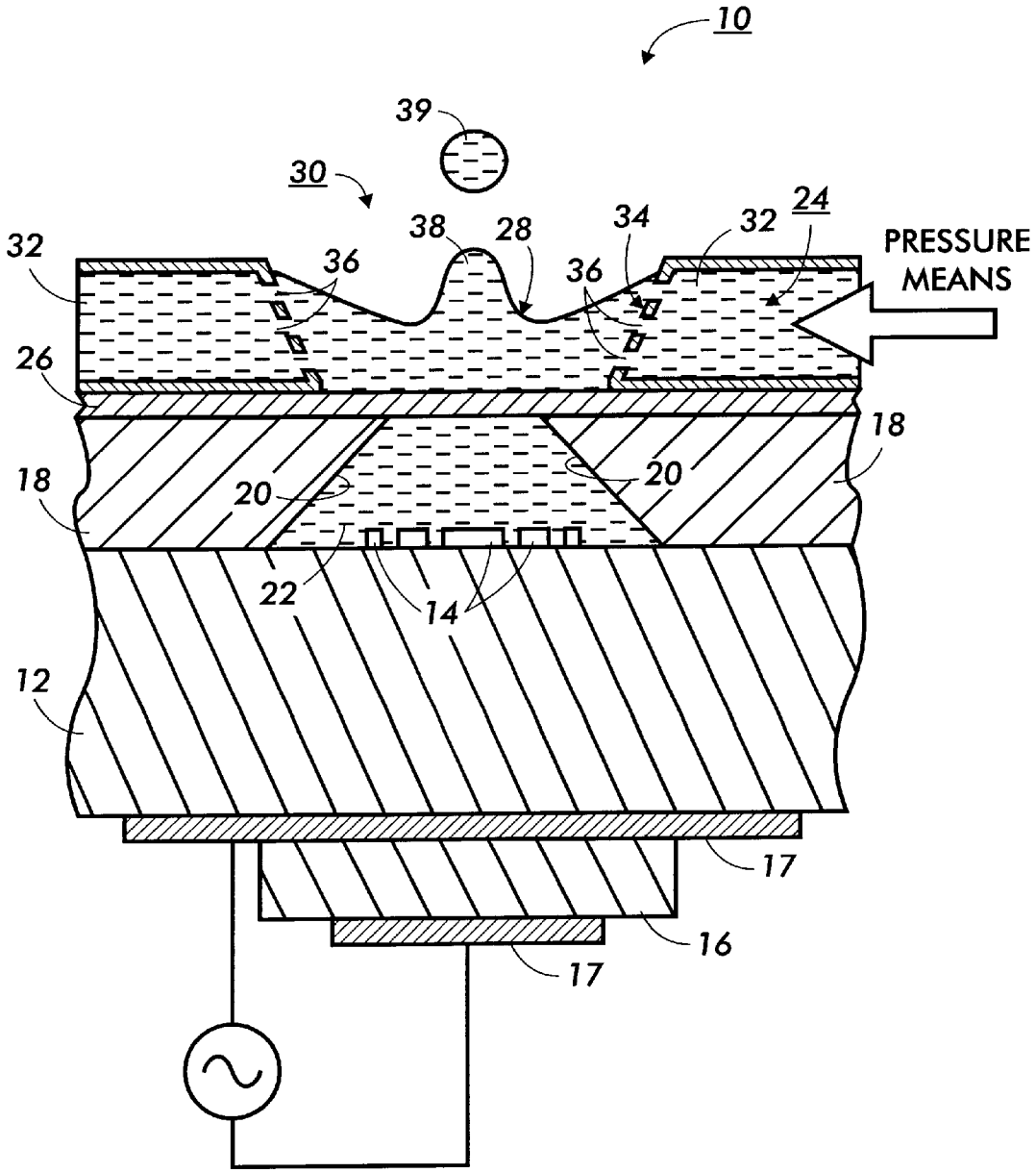
FIG. 1 PRIOR ART
FIG. 1 shows a cross-sectional view of a prior art droplet emitter for an acoustically actuated printer.
Figure 2:
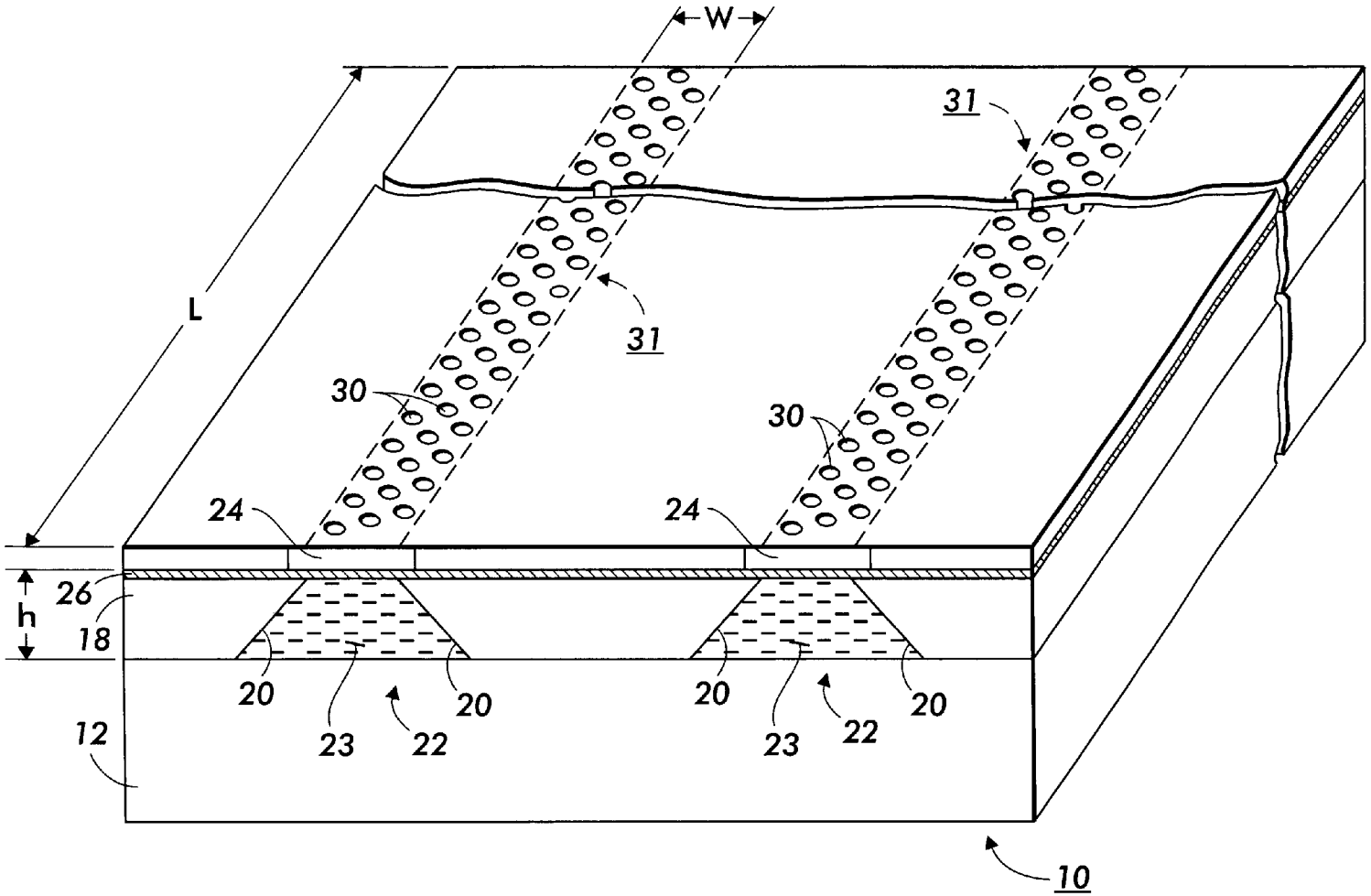
FIG. 2 PRIOR ART
FIG. 2 shows a perspective view of arrays of prior art droplet emitters shown in FIG. 1.

While the present invention will be described in connection with a preferred embodiment and method of use, if will be understood that it is hot intended to limit the invention to that embodiment or procedure. On the contrary, it is intended to cover all alternatives, modifications and equivalents as may be included within the spirit and scope of the invention as defined by the appended claims.

Alpha-Numeric List of Elements $d_1$ capping structure support aperture diameter
$d_2$ liquid level control aperture diameter
h height of emission fluid
Hf flow direction of heat
L length of an array
W width of an array
$F_1$ flow direction of emission fluid
$F_2$ flow direction of low attenuation fluid
10 droplet emitter
12 base substrate
14 acoustic lens
16 transducer
17 electrode
18 top support
20 sidewall
22 liquid cell
23 low attenuation liquid
24 reservoir
26 acoustically thin capping structure
28 free surface
30 aperture
31 array
32 emission fluid
34 sidewall
36 portholes
38 mound
39 droplet
40 droplet emitter
42 base substrate
44 acoustic lens
46 transducer
48 emission fluid
49 aperture
50 acoustically thin capping structure
51 capping structure support
52 flowing low attenuation liquid
54 array
56 liquid level control plate
58 free surface
60 aperture
62 fluid manifold
64 sheet flow partition
66 manifold inlet liquid tube
68 manifold outlet liquid tube
70 heat sink
72 heat conductive back plane
74 thermally conductive connection
76 circuit component
78 spring clip
80 circuit chip
82 bridge plate
84 flexible seal
86 manifold inlet
88 manifold outlet
90 liquid sheet flow chamber
92 lower manifold
94 LLC gap protrusion
96 bond wire
98 upper manifold
100 flex
102 baffle
120 manifold inlet
122 manifold outlet
128 liquid flow chamber

DETAILED DESCRIPTION OF THE INVENTION

Figure 3:
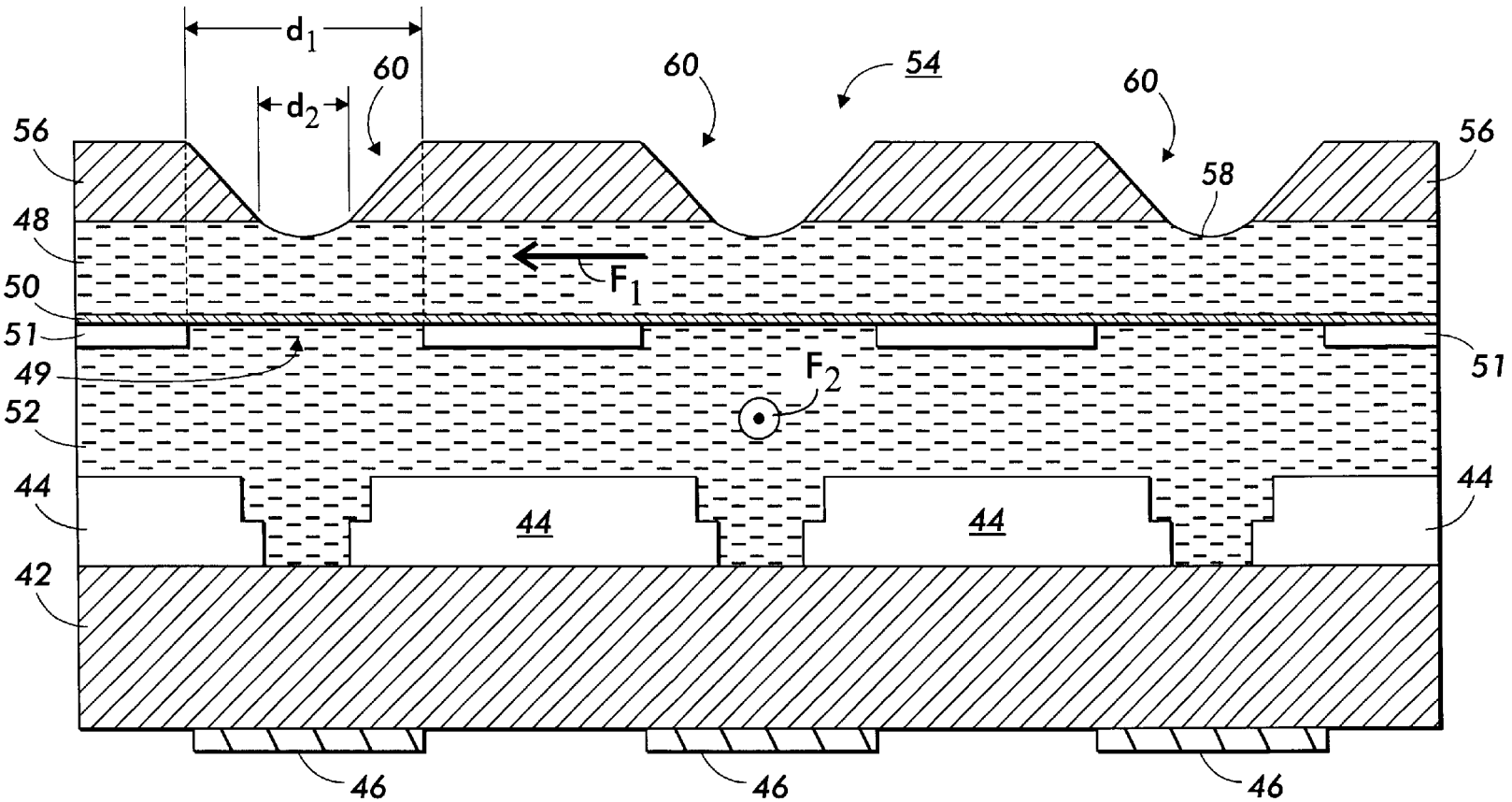
FIG. 3 show a cross-sectional view of a droplet emitter according to the present invention.

Turning now to FIG. 3, there is shown a cross-sectional view of a droplet emitter 40 configured according to the present invention. The droplet emitter 40 has a base substrate 42 with transducers 46 on one surface and acoustic lenses 44 on an opposite surface. Spaced from the base substrate 42 is art acoustically thin capping structure 50. The acoustically thin capping structure 50 may be either a rigid structure made from, for example, silicon, or a membrane structure made from, for example, parylene, mylar, or kapton. In order to preserve the acoustic transmission properties the acoustically thin capping structure 50 should preferably have either a very thin thickness such as approximately $1/10^{th}$ the wavelength of the transmitted acoustic energy in the membrane material or a thickness substantially equal to a multiple of one-half the wavelength of the transmitted acoustic energy in the membrane material. Whether the acoustically thin capping structure 50 is made from a rigid material or a membrane it will structurally be relatively thin and have a tendency to be fragile and susceptible to breakage. To provide additional stability for the acoustically thin capping structure 50 it is supported by a capping structure support 51. The capping structure support 51 is interposed between the base substrate 42 and the acoustically thin capping structure 50, adjacent to the acoustically thin capping structure 50 and spaced from the base substrate 42. The capping structure support 51 has a series of spaced apart apertures 49, positioned in a like manner to lens array 44, so that focussed acoustic energy may pass by the capping structure support 51 substantially unimpeded. The apertures 49 have a capping structure support aperture diameter $d_1$. The addition of the capping structure support 51 allows for a wider variety of materials to be used as the acoustically thin capping structure 50 and adds strength and stability to the acoustically thin capping structure 50.

The chamber created by the space between the base substrate 42 and the acoustically thin capping structure 50 is filled with a low attenuation fluid 52. The chamber could be filled with the low attenuation fluid 52 and sealed as described hereinabove with respect to FIG. 1, however, benefits can be achieved if the chamber is not sealed and the low attenuation fluid 52 is allowed to flow through the chamber. FIG. 3 shows a flow direction of the low attenuation fluid $F_2$ which is orthogonal to the plane of the drawing and out of the plane of the drawing. However, while a droplet emitter 40 which has a flow direction of the low attenuation fluid $F_2$ in this direction may possibly be the easiest to construct, other flow directions are possible and may even in some circumstances be preferable. For instance, the droplet emitter 40 could also be constructed such that the flow direction of the low attenuation fluid $F_2$ was flowing in the plane of the drawing in either a "right" or "left" direction.

Flowing the low attenuation liquid 52 enables the low attenuation liquid 52 to help maintain thermal uniformity of the droplet emitter 40. In particular, not only does the low attenuation liquid 52 itself have less opportunity to heat up due to excess heat generated during the acoustic emission process but because the low attenuation liquid 52 is in thermal contact with the substrate 42 the low attenuation liquid 52 may also absorb excess heat generated in the substrate 42 during operation and prevent excess heating of the substrate 42 as well. Further, it can be appreciated that this structure of a thin capping structure over a relatively rigid capping support creates a fluidically sealed flow chamber enabling relatively high flow rates of the low attenuation fluid without changing the position of the capping structure with respect to the focussed acoustic beam. Consequently, rapid removal of excess generated heat and temperature uniformity is achieved.

Spaced from the acoustically thin capping structure 50 is a liquid level control plate 56. The acoustically thin capping structure 50 and the liquid level control plate 56 define a channel which holds an emission fluid 48. The liquid level control plate 56 contains an array 54 of apertures 60. The transducers 46, acoustic lenses 44, apertures 49 and apertures 60 are all axially aligned such that an acoustic wave produced by a single transducer 46 will be focussed by its aligned acoustic lens 44 at approximately a free surface 58 of the emission fluid 48 in its aligned aperture 60. When sufficient power is obtained, a droplet is emitted. It should be noted that the apertures 60 in the liquid level control plate 56 have a liquid level control plate aperture diameter $d_2$. In order to insure that the acoustic wave produced by a transducer will propagate substantially unimpeded through the aperture 49 in the capping structure support aperture diameter $d_1$ should be larger than the diameter of the acoustic beam as it passes through the aperture 49.

Figure 4:
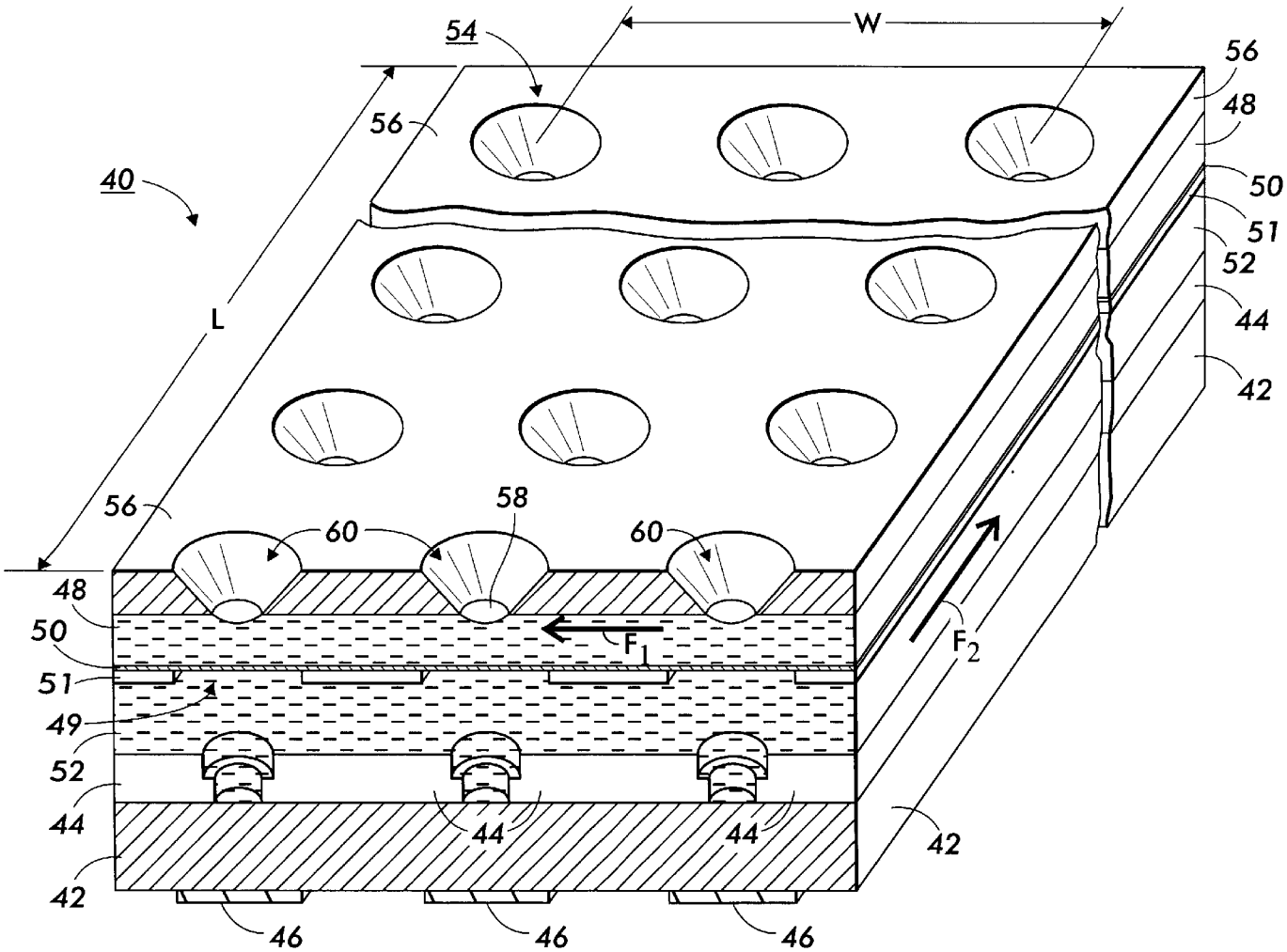
FIG. 4 shows a perspective view of the droplet emitter shown in FIG. 3.

FIG. 4 shows a perspective view of the droplet emitter 40 shown in FIG. 3. The array 54 of apertures 60 can be clearly seen on the liquid level control plate 56. The flow direction of the low attenuation fluid $F_2$ between the base substrate 42 and the acoustically thin capping structure 50 can be clearly seen as well as the flow direction of the emission fluid $F_1$ between the acoustically thin capping structure 50 and the liquid level control plate 56. In FIG. 4 a length L and a width W of the array 54 can also be seen and the width W is the smaller dimension. The flow direction of the emission fluid $F_1$ is arranged such that the emission fluid 48 flows along the shorter width W of the array 54 instead of along the longer length L of the array 54. When the flow direction of the emission fluid $F_1$ is arranged to be orthogonal to the flow direction of the low attenuation fluid $F_2$, then it is preferable to arrange the flow direction of the emission fluid $F_1$ such that the emission fluid 48 flows along the shorter width W of the array 54 instead of along the longer length L because the emission fluid is more sensitive to constraining factors. For instance, small pressure deviations in the emission fluid 48 along the array 54 can lead to misdirectionality of the emitted droplets. However, in this configuration, the flow velocity of the emission fluid 48 is substantially independent of many of the constraining factors.

If however, the droplet emitter 40 is constructed such that the flow direction of the emission fluid $F_1$ and the flow direction of the low attenuation fluid $F_2$ are substantially parallel instead of orthogonal to each other, then it is preferable that both the flow direction of the emission fluid $F_1$ and the flow direction of the low attenuation fluid $F_2$ be along the width of the array for the reasons stated above.

Figure 5:
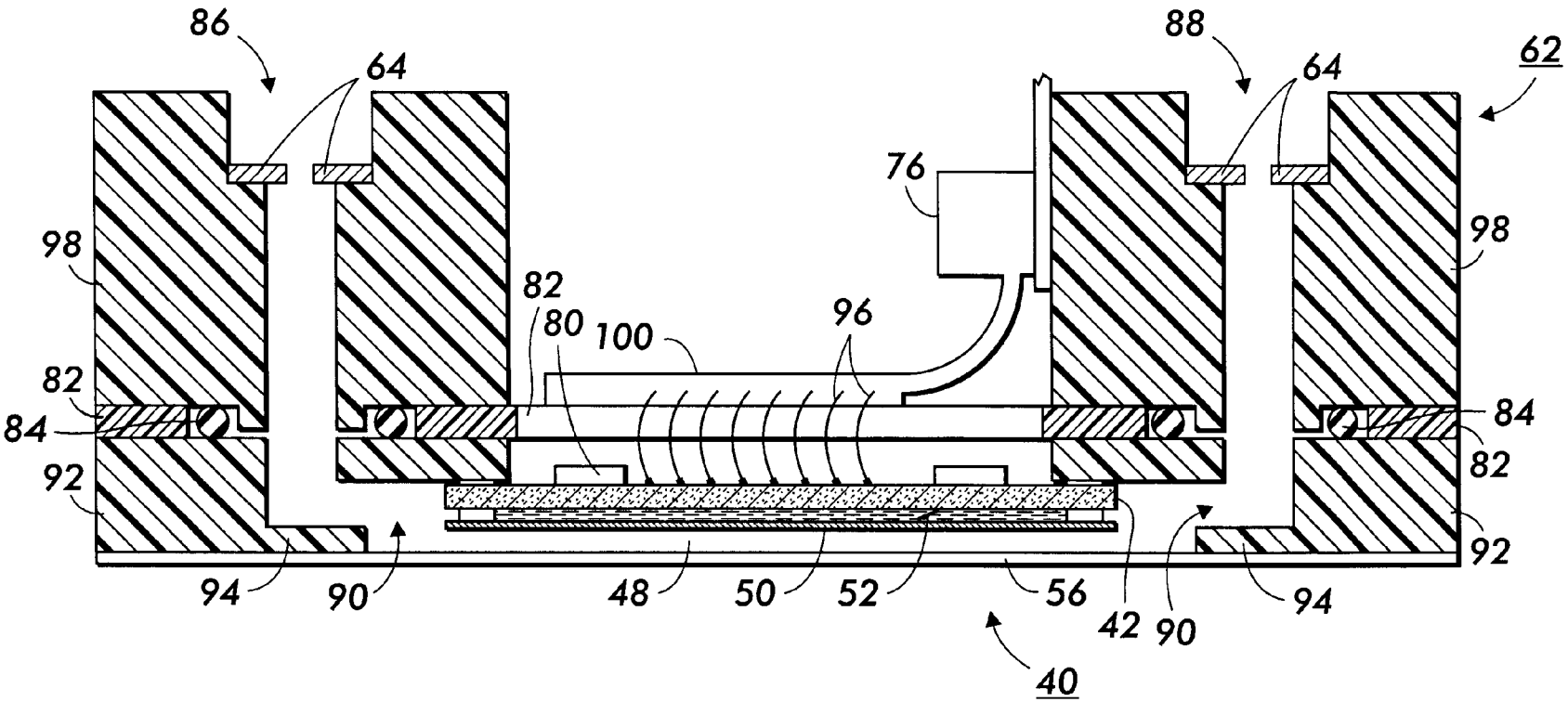
FIG. 5 shows a cross-sectional view of the droplet emitter shown in FIG. 3 with an emission fluid manifold attached.

FIG. 5 shows a cross-sectional view of how the droplet emitter of FIGS. 3 and 4 can be assembled with a fluid manifold 62 to provide the emission fluid 48 to the droplet emitter. While unitary construction of the fluid manifold 62 may in some circumstances be desirable, in this implementation the fluid manifold 62 is divided into two portions, an upper manifold 96 and a lower manifold 92 with a flexible seal 84 therebetween.

The lower manifold 92, which is in direct contact with the base substrate 42 and the liquid level control plate 56 must be made from materials which have a thermal expansion coefficient relatively similar to the material the base substrate 42 is made from and preferably within a range of $+/-0.5\times10^{-6}$ per degree centigrade. This is primarily because the base substrate 42 during the course of alignment to the lower manifold and the liquid level control plate 56 and subsequent bonding and curing steps may go through large temperature variations of up to 250 degrees centigrade and a differential thermal expansion of the parts of more than 5 microns can damage the assembly. The most common material for constructing the base substrate 42 is glass which has a thermal expansion coefficient of approximately $3.9\times10^{-6}$ per degree centigrade.

Possible materials for constructing the lower manifold 92, when the substrate 42 is made from glass, include alloy 42, Kovar, various ceramics and glass, which all have acceptable thermal expansion. However, as the length of the droplet emitter 40 increases, and hence the length of the base substrate 42 and the liquid level control plate 56, either the allowable variation in thermal expansion coefficients, or the maximum temperature variation, or both must be correspondingly decreased.

The lower manifold 92 has a liquid level control gap protrusion 94. The liquid level control plate 56 is attached to a liquid level control gap protrusion 94. The liquid level control gap protrusion 94 is used to achieve a precise spacing between the base substrate 42 and the liquid level control plate 56 when the parts are assembled into the droplet emitter 40 and attached to the lower manifold 92.

The assembly of the droplet emitter 40 and attachment to the fluid manifold 62 creates a liquid sheet flow chamber 90 starting at the manifold inlet 86, proceeding through the gap between the acoustically thin capping structure 50 and the liquid level control plate 56 and ending at the manifold outlet 88. Both the manifold inlet 86 and the manifold outlet 88 have a sheet flow partition 64 which creates and maintains a sheet flow of the liquid flowing through the liquid sheet flow chamber 90.

Figure 6:
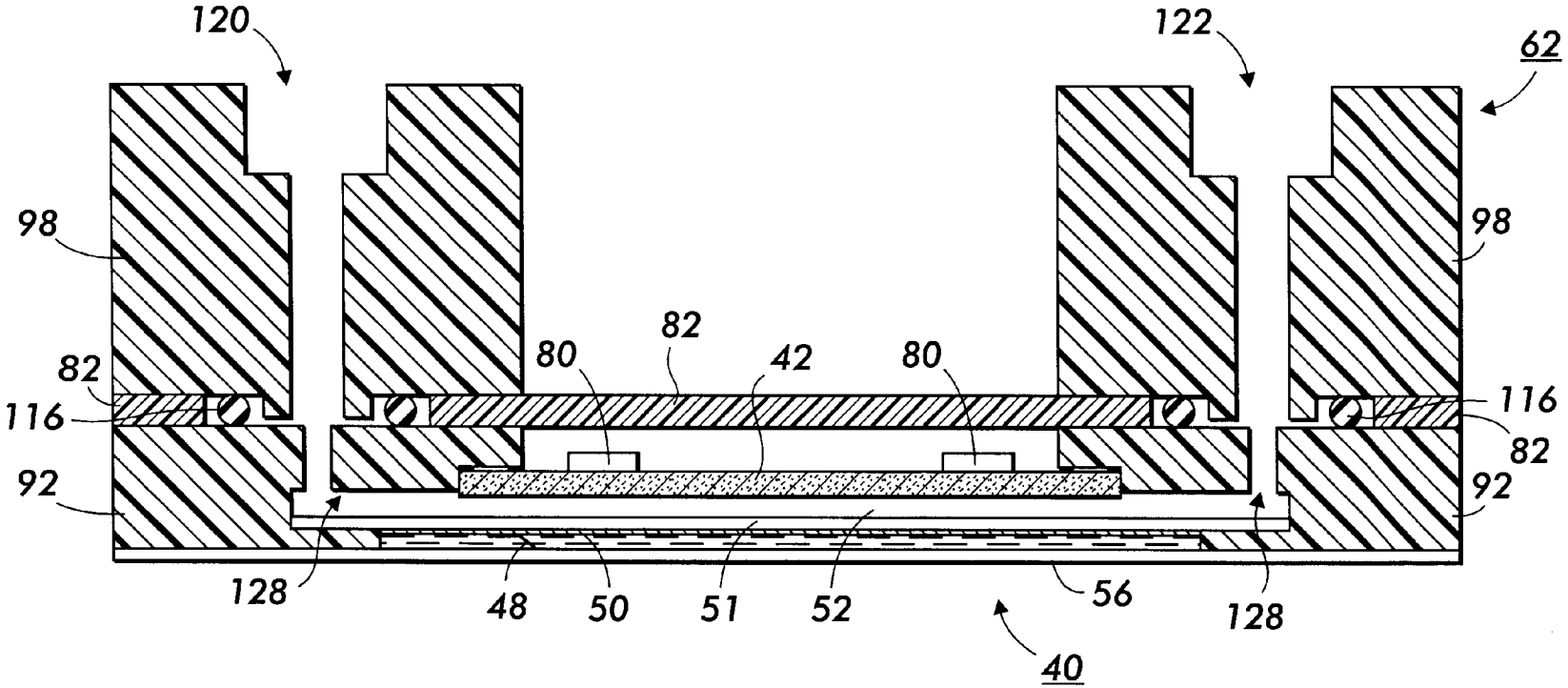
FIG. 6 shows a cross-sectional view of the droplet emitter shown in FIG. 3 with a low attenuation fluid manifold attached.

An additional part assembled with the lower manifold 92 and the droplet emitter stack 40 is a bridge plate 82 as shown in FIG. 6. The bridge plate 82 is used to mount a flex cable 100. The flex cable 100 is used to provide connections for discrete circuit components 76 which are mounted on the flex cable 100 and are used to generate and control the focussed acoustic wave. Bond wires 96 provide electrical connections between the flex cable 100 and circuit chips 80 mounted on the base substrate 42. Control circuitry for the droplet emitter is described for instance in U.S. Pat. No. 5,786,722 by Buhler et al. titled "Integrated RF Switching Cell Built In CMOS Technology And Utilizing A High Voltage Integrated Circuit Diode With A Charge Injecting Node" issued Jul. 28, 1998, or, U.S. Pat. No. 5,389,956 by Hadimioglu et al. titled "Techniques For Improving Droplet Uniformity In Acoustic Ink Printing" issued Feb. 14, 1995, both incorporated by reference hereinabove.

FIG. 6 shows a cross-sectional view of how the droplet emitter of FIGS. 3 and 4 can be assembled with a fluid manifold 62 to provide the low attenuation fluid 52 to the droplet emitter. While unitary construction of the fluid manifold 62 may in some circumstances be desirable, in this implementation the fluid manifold 62 is again divided into two portions as described hereinabove, an upper manifold 98 and a lower manifold 92 with a flexible seal 84 therebetween.

The lower manifold 92, which is in direct contact with the base substrate 42 and the capping support plate 51 must be made from materials which have a thermal expansion coefficient relatively similar to the material, the base substrate 42 is made from and preferably within a range of $+/-0.5\times10^{-6}$ per degree centigrade. This is primarily because the base substrate 42 during the course of alignment to the lower manifold and the capping support plate 51 and subsequent bonding and curing steps may go through large temperature variations of up to 250 degrees centigrade and a differential thermal expansion of the parts of more than 5 microns can damage the assembly. The most common material for constructing the base substrate 42 is glass which has a thermal expansion coefficient of approximately $3.9\times10^{-6}$ per degree centigrade.

Possible materials for constructing the lower manifold 92, when the substrate 42 is made from glass, include alloy 42, Kovar, various ceramics and glass, which all have acceptable thermal expansion. However, as the length of the droplet emitter 40 increases, and hence the length of the base substrate 42 and the capping support plate 51, either the allowable variation in thermal expansion coefficients, or the maximum temperature variation, or both must be correspondingly decreased.

The capping support plate 51 is positioned below the substrate 42 and sealed around the substrate in a manner such as to achieve a precise spacing between the base substrate 42 and the acoustically thin capping structure 50 when the parts are assembled into the droplet emitter 40 and attached to the lower manifold 92.

The assembly of the droplet emitter 40 and attachment to the fluid manifold 62 creates a liquid flow chamber 128 starting at the manifold inlet 120, proceeding through the gap between the bas e substrate 42 and the acoustically thin capping structure 50 and ending at the manifold outlet 122.

Figure 7:
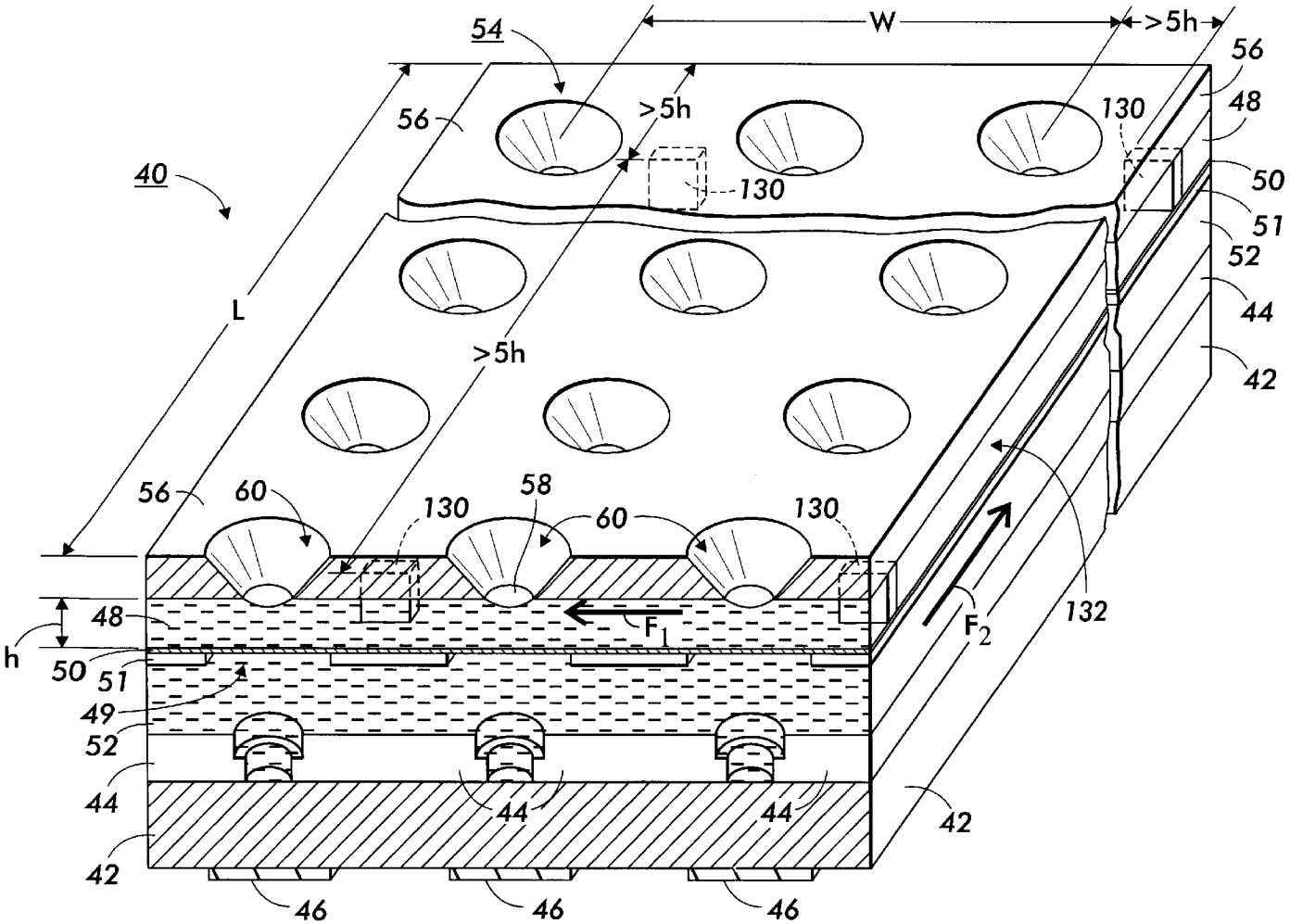
FIG. 7 shows a perspective view of the droplet emitter shown in FIG. 4 with the addition of liquid level control plate supports.

It should be noted that in the embodiments shown in FIGS. 3, 4, and 5, the liquid sheet flow chamber 90 has no physical or structural obstructions in the path of the flow, particularly in the portion of the sheet flow chamber 90 between the base substrate 42 and the acoustically thin capping structure 50, This is the preferred embodiment as it ensures a uniform flow velocity for all the emitters across the entire length of the array. Furthermore, this decreases the possibility of trapped a air-bubbles created during filling of the printhead or by perturbations in the emission fluid 48 flow and allows for the rapid removal of air bubbles that may get introduced into the system. However, it should be noted that as the length L of the droplet emitter gets larger, it may be desirable to provide additional support to the liquid level control plate 56. Such liquid level control plate supports 130 may be placed within the liquid flow chamber 90 provided they have a minimal footprint and are placed a minimal distance of at least five times the channel height h from both the ends of the liquid flow channel 90 and each other as shown in FIG. 7. Note that the liquid level control plate supports are placed in the flow direction, effectively creating several large flow chambers 132 within a portion of the liquid sheet flow chamber 90.

Figure 8:
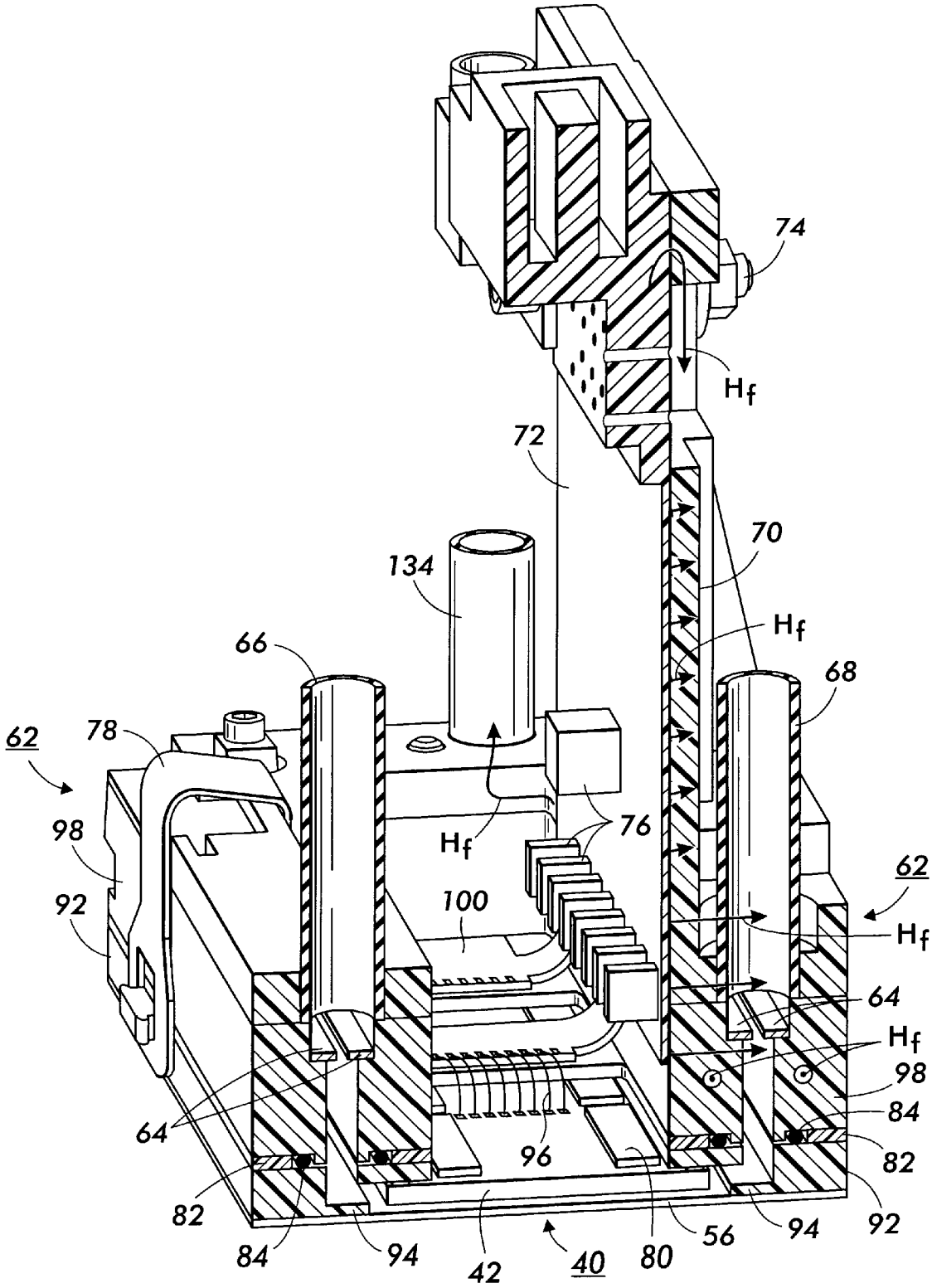
FIG. 8 shows a perspective view of cross-sectional view of the droplet emitter shown in FIG. 5 with additional thermally conductive components.

FIG. 8 shows a perspective view of the cross section of the droplet emitter shown in FIG. 5 with additional thermally conductive components. Specifically, a heat conductive backplane is inserted in the gap between the flex cable 100 and the fluid manifold 62. Additionally, a thermally conductive connection 74 is made between the heat conductive back plane 72 and the upper manifold 98. The thermal conduction between the heat conductive backplane 72 and the fluid manifold 62 allows heat generated by the circuit chips 80 to be transferred to the low attenuation fluid 52 and the emission fluid 32 via the fluid manifold 62 along a path as shown by flow direction of heat arrows Hf. This allows excess heat to be carried away from the droplet emitter 40 and helps to maintain thermal uniformity within the droplet emitter 40.

Additionally, manifold inlet fluid tube 134 and manifold outlet fluid tube 136 are also shown attached to the fluid manifold 62 along a path as shown by flow direction of heat arrows Hf.

Figure 9:
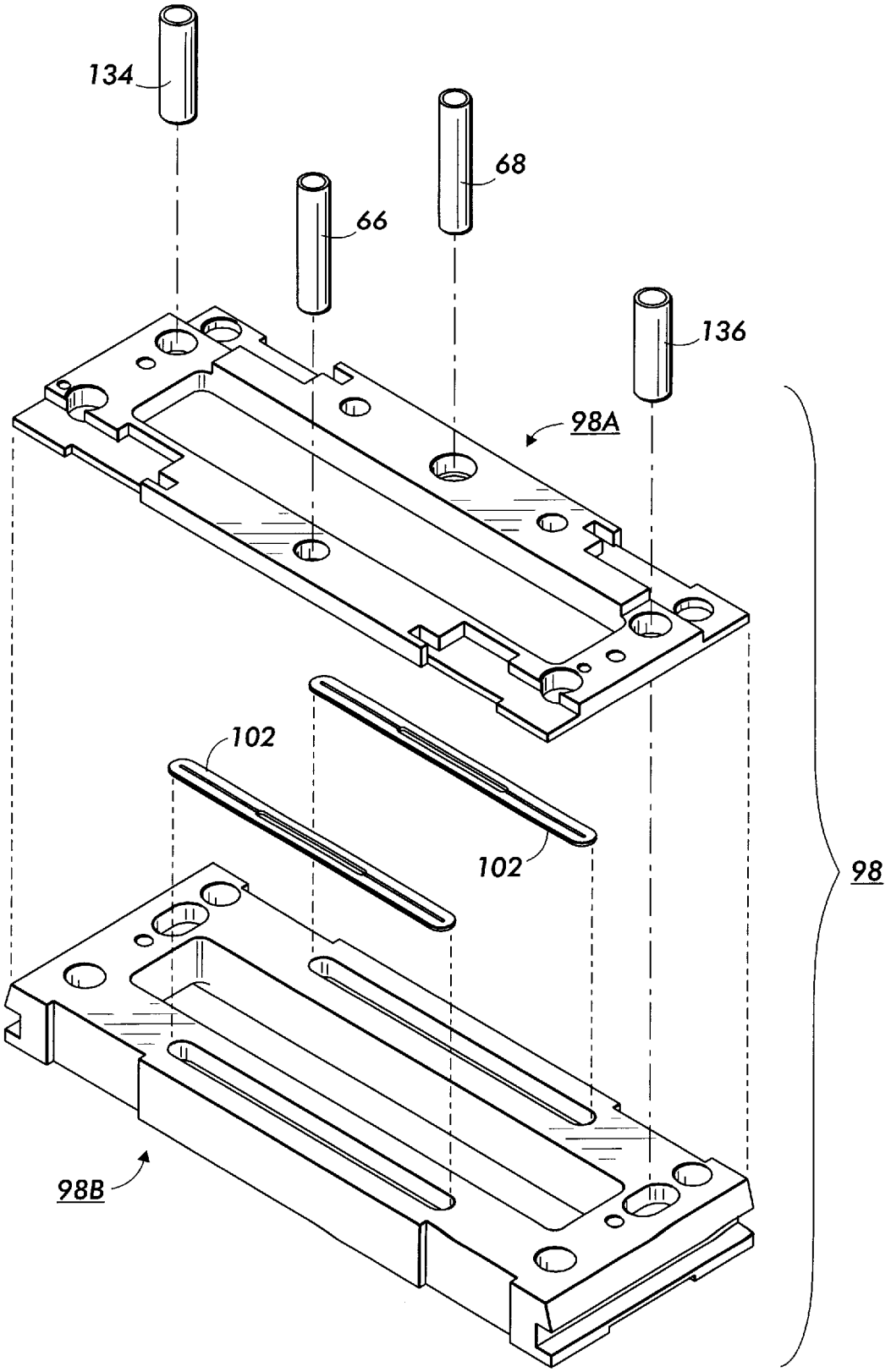
FIG. 9 shows an exploded view of the parts used to assemble an upper manifold.

Another feature shown in FIG. 8 is spring clip 78. The spring clip 78 is used to secure the entire assembly but allows for some movement of upper manifold 98 relative to the lower manifold 92 due to the different thermal expansion coefficients of the upper manifold 98 and the lower manifold 92. However, other fastening methods that would accomplish the same function are also known. For instance, the upper manifold 98 could be attached to the lower manifold 92 with an elastomer glue joint. An elastomer glue joint would fixedly attach the upper manifold 98 to the lower manifold 92 while also allowing for some movement of the upper manifold 98 relative to the lower manifold 92 due to the different thermal expansion coefficients. However, when spring clips. 78 are used, their number and position should be such that the flexible seal is leak free and the seal compression is uniformly distributed along the length L of the array 54 of the droplet emitter 40 in order to minimize resultant gap nonuniformities between the base substrate 42 and the liquid level control plate 56. In order to accomplish this, it should be noted that the two flexible seals 84, in the embodiment shown in FIG. 5 are two elongated o-rings. The compliance or stiffness of this type of o-ring seal is fairly uniform along the length of the o-ring except for the ends of the o-ring. This type of o-ring is much stiffer at the ends than along the rest of the length of the o-ring. Therefore, in order to insure that the seal is under substantially uniform compression, more force is needed at the ends of the o-ring than along the rest of the length of the o-ring. One method of accomplishing this, is to do as shown in FIG. 9, and place the spring clips 78 over the stiffer ends of the o-rings. However, this is not the only method available, for instance, a full lengthwise spring clip with applies more clamping force above the ends of the o-ring than along the rest of the length of the o-ring could be used. Also, a series of small spring clips applying a small force could be plated along the length of the o-ring while using larger spring clips which apply a greater force at the ends of the o-ring.

Figure 10:
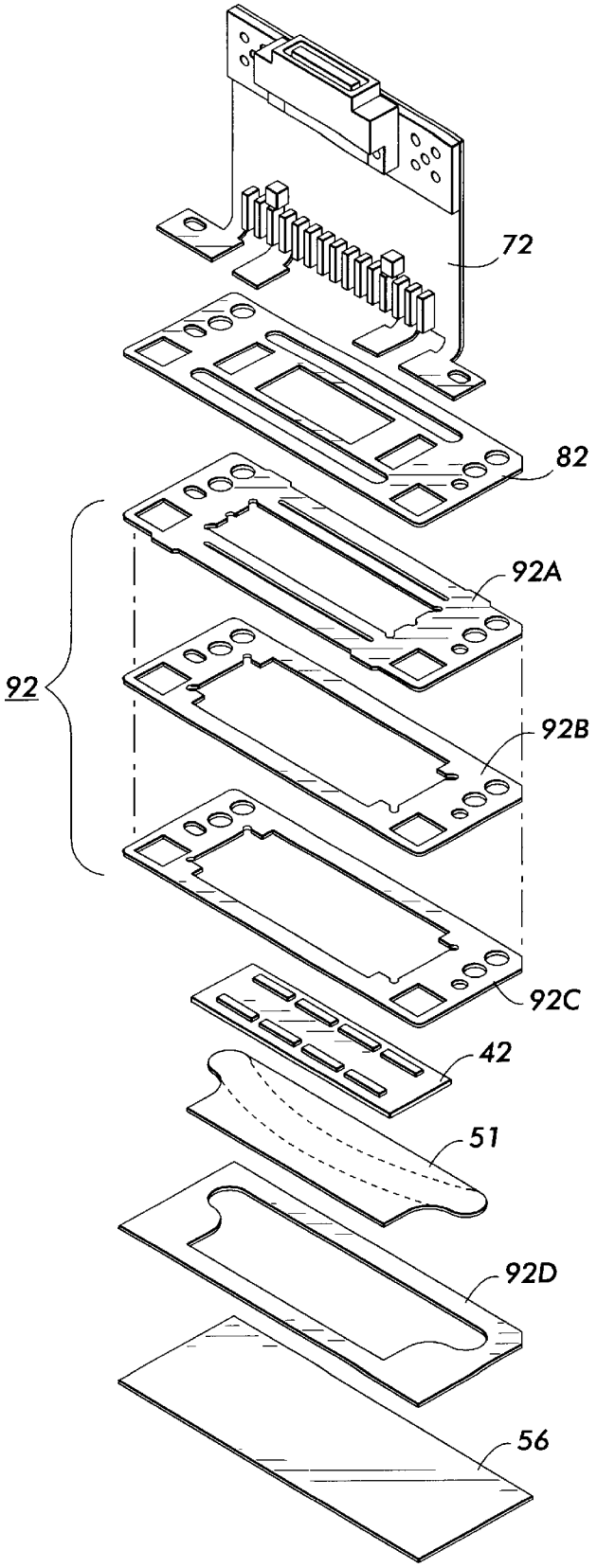
FIG. 10 shows an exploded view of the parts used to assemble a droplet emitter with a lower manifold and flex circuitry.

FIG. 9 shows an exploded view of the upper manifold 98 while FIG. 10 shows an exploded view of the lower manifold 92. Again, while many manufacturing techniques are known, one method to make the upper manifold 98 is to divide the upper manifold 98 into easily manufacturable components which can then be assembled into the upper manifold 98. The upper manifold 98 is divided into an upper portion 98*a* and a lower portion 98*b* which are then assembled with a pair of baffles 102 which is inserted therebetween. The baffles 102 are used to aide in the conversion of the liquid flow of the emission fluid 48 into the upper manifold 98 in a sheet flow. The manifold inlet tubes 66, 68, and outlet tubes 134, 136 can then be inserted into the upper portion 98*a* to complete assembly of the upper manifold 98.

The lower manifold 92 can be assembled from a stack of parts in a similar manner along with the flex cable 72, base substrate 42, and the liquid level control plate 56. The lower manifold 92 is manufactured in four sheet-like portions 92*a*, 92*b*, 92*c*, and 92*d*. This allows for easy manufacture of the lower manifold 92 because each portion can be easily and accurately stamped, chemically etched or laser cut out of a sheet material such as readily available sheet metal stock. The liquid sheet flow chambers 90, 128 are defined by the patterns removed out of each portion 92*a*, 92*b*, 92*c*, 92*d* when the portions are stacked and assembled together with the base substrate 42, the capping structure support 51 and the liquid level control plate 56.

What is claimed is:

1. A droplet emitter array comprising:

a) a first substrate having a thermal expansion coefficient being so arranged and constructed to provide an array of focussed acoustic waves having a wavelength, the array of focussed acoustic waves having a length and a corresponding length direction, and a width and a corresponding width direction, wherein the length is greater than the width, b) a second substrate being spaced from the first substrate, the second substrate comprising an acoustically thin portion having a thickness and a surface and an aperture array portion adjacent to and in contact with the surface of the acoustically thin portion, the second substrate being arranged relative to the first substrate such that each aperture may pass substantially unimpeded focussed acoustic waves from the first substrate before the focussed acoustic waves pass through the acoustically thin portion, and wherein the space between the first and second substrates forms at least a portion of a first liquid chamber, and c) a third substrate being spaced from the second substrate, the third substrate having an array of apertures, the third substrate being arranged relative to the first and second substrates such that each aperture may receive focussed acoustic waves from the first substrate after they have passed through the second substrate wherein the space between the second and third substrates forms at least a portion of a second liquid chamber having an inlet and an outlet which have been adapted to receive a flow of a liquid such that a free surface of the liquid is formed by each of the apertures in the second substrate, wherein the focussed acoustic waves received by each aperture are focussed substantially at the free surface of the liquid formed in the aperture, and the flow of liquid flows in through the inlet, out through the outlet.

2. the droplet emitter of claim 1 wherein the first liquid chamber is sealed.

3. The droplet emitter of claim 2 wherein the first substrate further comprises:

a) an array of transducers for generating acoustic waves, and b) an array of focussing devices so arranged to receive the generated acoustic waves and to focussing the received acoustic waves substantially at the free surface of the liquid formed in the apertures.

4. The droplet emitter of claim 1 wherein the first liquid chamber is so constructed and arranged to have an inlet and an outlet which have been adapted to receive a flow of a liquid such that the flow of liquid flows in through the inlet, through the first liquid chamber and out through the outlet.

5. The droplet emitter of claim 4 wherein the first liquid flow chamber is so constructed and arranged such that the flow of liquid flows in substantially the length direction of the array of focussed acoustic waves.

6. The droplet emitter of claim 4 further comprising a fluid manifold having an inlet, an outlet, and a thermal expansion coefficient so constructed and arranged for receiving the flow of liquid in the inlet and providing a laminar flow of a liquid to said first liquid flow chamber to pass through the first liquid flow chamber and out through the outlet.

7. The droplet emitter of claim 1 wherein the second liquid flow chamber is so constructed and arranged such that the flow of liquid flows in substantially the width direction of the array of focussed acoustic waves.

8. The droplet emitter of claim 1 wherein the thickness of the acoustically thin portion is substantially equal to a multiple of one-half the wavelength of the focussed acoustic waves.

9. The droplet emitter of claim 1 wherein the thickness of the acoustically thin portion is substantially one-tenth of the wavelength of the focussed acoustic waves.

10. The droplet emitter array of claim 9 wherein the second liquid flow chamber is so constructed and arranged such that at least a portion of the flow of liquid flows in substantially the width direction of the array of focussed acoustic waves.

11. The droplet emitter array of claim 9 wherein the first liquid flow chamber is so constructed and arranged such that at least a portion of the flow of liquid flows in substantially length direction of the array of focussed acoustic waves.

12. The droplet emitter of claim 1 further comprising circuitry for generating and controlling the focussed acoustic waves wherein said circuitry is thermally connected to the first liquid flow chamber for transferring heat to the flow of liquid before it leaves the liquid flow chamber.

13. The droplet emitter of claim 1 further comprising a fluid manifold having an inlet, an outlet, and a thermal expansion coefficient so constructed and arranged for receiving the flow of liquid in the inlet and providing a flow of a liquid to said second liquid flow chamber to pass through the second liquid flow chamber and out through the outlet.

14. The droplet emitter of claim 13 wherein at least a portion of the fluid manifold is made from a material having a thermal expansion coefficient within $+/-0.5\times10^{-6}$ per degree centigrade of the thermal expansion coefficient of the first substrate.

15. The droplet emitter of claim 13 wherein at least a portion of the fluid manifold is made from a material having a thermal expansion coefficient wherein the first thermal expansion coefficient and the second thermal expansion coefficent are substantially the same.

16. The droplet emitter of claim 13 wherein a first portion of the fluid manifold is made from a material having a thermal expansion coefficient within $+/-0.5\times10^{-6}$ per degree centigrade of the thermal expansion coefficient of the first substrate and a second portion of the fluid manifold is made from a material having a thermal expansion coefficient substantially different from the thermal expansion coefficient of the first substrate and further comprising a fluidic seal between the two portions.

17. The droplet emitter of claim 16 wherein the fluidic seal comprises a compressed o-ring seal, having a compliance, wherein the compression is substantially uniform along the length of the seal.

18. The droplet emitter of claim 17 wherein the compression to the o-ring seal is supplied by at least one clamp.

19. The droplet emitter of claim 17 wherein the clamping force varies approximately proportionally to the compliance of the o-ring seal.

20. The droplet emitter of claim 16 wherein the fluidic seal comprises an elastomeric adhesive.

21. A droplet emitter array comprising:

a) a first substrate having a first thermal expansion coefficient being so arranged and constructed to provide an array of focussed acoustic waves, the array of focussed acoustic waves having a length and a width wherein the length is greater than the width, and said substrate having a given thermal expansion coefficient, b) a second substrate being spaced from the first substrate, the second substrate having an acoustically thin portion having a thickness and a surface and an aperture array portion adjacent to and in contact with the surface of the acoustically thin portion, the second substrate being arranged relative to the first substrate such that each aperture may pass focussed acoustic waves substantially unimpeded from the first substrate before they pass through the acoustically thin portion, c) a third substrate being spaced from the second substrate, the third substrate having an array of apertures, the third substrate being arranged relative to the first and second substrates such that each aperture may receive focussed acoustic waves from the first substrate after they have passed through the aperture array of the second substrate, d) a first liquid flow chamber at least partially interposed between the first and second substrates, the first liquid flow chamber having an inlet and an outlet and being so constructed and arranged to receive a flow of a liquid such that the flow of liquid flows in through the inlet, out through the outlet, and e) a second liquid flow chamber at least partially interposed between the second and third substrates, the second liquid flow chamber having an inlet and an outlet and being so constructed and arranged to receive a flow of a liquid such that a free surface of the liquid is formed by each of the apertures in the third substrate wherein the focussed acoustic waves received by each aperture are focussed substantially at the free surface of the liquid formed in the aperture, and the flow of liquid flows in through the inlet, out through the outlet.

22. A droplet emitter array comprising:

a) a first substrate said first substrate having a given thermal expansion coefficient, being so arranged and constructed to provide an array of focussed acoustic waves, the array of focussed acoustic waves having a length and a width wherein the length is greater than the width, b) a second substrate being spaced from the first substrate, the second substrate having an acoustically thin portion having a thickness and a surface and an aperture array portion being adjacent to and in contact with the surface of the acoustically thin portion, the second substrate being arranged relative to the first substrate such that each aperture may pass focussed acoustic waves substantially unimpeded from the first substrate before they pass through the acoustically thin portion, c) a third substrate being spaced from the second substrate, the third substrate having an array of apertures, the third substrate being arranged relative to the first and second substrates such that each aperture may receive focussed acoustic waves from the first substrate after they have passed through the aperture array of the second substrate, d) a first liquid flow chamber at least partially inter posed between the first and second substrates, the first liquid flow chamber having an inlet and an outlet and being so constructed and arranged to receive a flow of a liquid such that the flow of liquid flows in through the inlet, out through the outlet, and e) at least one second liquid flow chamber at least partially interposed between the second and third substrates, the at least one second liquid flow chamber having an inlet and an outlet and being so constructed and arranged to receive a flow of a liquid such that a free surface of the liquid is formed by each of the apertures in the third substrate, wherein the focussed acoustic waves received by each aperture are focussed substantially at the free surface of the liquid formed in the aperture, and the flow of liquid flows in through the inlet, out through the outlet, and said at least one second liquid flow chamber having a height and a width wherein the width is at least a multiple of five times the height.

* * * * *